United States Patent [19]

Vahlbrauk

[11] 4,303,125

[45] Dec. 1, 1981

[54] HEAT EXCHANGE STRUCTURAL ELEMENT

[76] Inventor: Karl H. Vahlbrauk, Kriegerweg 1, 3353 Bad Gandersheim, Fed. Rep. of Germany

[21] Appl. No.: 141,565

[22] Filed: Apr. 18, 1980

[30] Foreign Application Priority Data

Apr. 26, 1979 [DE] Fed. Rep. of Germany ..... 2916799

[51] Int. Cl.[3] ..... F28F 13/14

[52] U.S. Cl. ..... 165/168; 126/448; 126/901; 165/185; 165/DIG. 8

[58] Field of Search ..... 165/DIG. 8, 146, 133, 165/170, 180, 185, 168; 126/448, 444, 445, 901

[56] References Cited

U.S. PATENT DOCUMENTS

| | | | |
|---|---|---|---|
| 1,192,245 | 7/1916 | Turner | 165/158 |
| 3,929,425 | 12/1975 | Valdo | 165/168 |
| 4,157,929 | 6/1979 | Kubicek | 165/DIG. 8 |
| 4,161,213 | 7/1979 | Heide et al. | 165/180 |
| 4,222,373 | 9/1980 | Davis | 126/448 |
| 4,222,434 | 9/1980 | Clyde | 165/DIG. 8 |

FOREIGN PATENT DOCUMENTS

| | | | |
|---|---|---|---|
| 2244143 | 4/1975 | France . | |
| 52-30962 | 9/1977 | Japan | 165/DIG. 8 |
| 1354502 | 5/1974 | United Kingdom | 165/DIG. 8 |
| 1388937 | 3/1975 | United Kingdom . | |
| 1393072 | 5/1975 | United Kingdom . | |
| 1535960 | 12/1978 | United Kingdom . | |
| 1564294 | 4/1980 | United Kingdom . | |

*Primary Examiner*—Sheldon J. Richter
*Attorney, Agent, or Firm*—Michael J. Striker

[57] ABSTRACT

A structural heat-exchange element has a structural part including a body portion of ceramic foam material and outer wall portions spaced from one another in a first direction so as to laterally outwardly bound the body portion and having a higher thermal conductivity than the latter, and conduit elements for passing a heat-carrying medium through the structural part and formed by a plurality of passages extending in the structural part in a second direction transverse to the first direction and each having at least an outer wall which is formed by the outer wall portion constituted of the material having a higher thermal conductivity.

21 Claims, 6 Drawing Figures

II
II

HEAT EXCHANGE STRUCTURAL ELEMENT

BACKGROUND OF THE INVENTION

The present invention relates to a block-shaped or plate-shaped structural heat-exchange element to be installed at predetermined locations, particularly to a heating body or a cooling body with conduits for passing a heat-carrying medium.

It is known to utilize structural heat-exchange elements which are formed by metallic bodies having various shapes and formed so as to pass a respective heat-carrying medium, particularly heating water or cooling water. The known metallic heating bodies have as a rule different dimensions and constructions and are formed as radiators or heating plates, whereupon a heating body of a predetermined dimension depending upon the heat requirements in a space to be heated, is selected and mounted. Adoption of such metallic heating bodies to the heat requirements or to the respective rough-in space is connected with considerable difficulties and especially considerable expenses, inasmuch as the metallic bodies, if they can be disassembled at all, must be disassembled and then again assembled to the desired dimension. The adaptability of such metallic bodies is extremely limited and the industrial prefabrication of them is possible only to a limited extent, inasmuch as they must be manufactured and be available in different dimensions and types.

Furthermore, the known metallic heating bodies possess the disadvantage in that they are considerably susceptible to corrosion and the action of ions. A further disadvantage of the known metallic bodies is that they do not sufficiently control the noise and are characterized by unpleasant stream noise and particularly crack noise. A still further disadvantage of the known metallic bodies is that they are installed as special structural elements and cannot be built in structural bodies proper as components of the latter.

SUMMARY OF THE INVENTION

Accordingly, it is an object of the present invention to provide a structural heat-exchange element which avoids the disadvantages of the prior art.

More particularly, it is an object of the present invention to provide a structural heat-exchange element which allows its industrial prefabrication and its practical adaptability to the respective heat requirements and the respective rough-in space, is practically corrosion-free and maintenance-free, guarantees a high noise absorption, and finally can be installed as a component of the structural bodies proper in the construction industry.

In keeping with these objects and with others that will become apparent hereinafter, one feature of the present invention resides, briefly stated, in a structural heat-exchange element in which conduits for passing a heat-carrying medium are formed as passages in a structural part composed of a body portion of a ceramic foam meterial and outer wall portions surrounding the body portion and constituted of a material with higher thermal conductivity, wherein at least an outer wall of each passage is formed by a respective one of the outer wall portions of the material of the higher thermal conductivity.

Ceramically bonded expanded clay which is described mainly in the German Pat. No. 1,914,372 can be utilized as ceramic foam material for the body portion and also for the outer wall portions. The formation of the passages in such a body portion with outer wall portions allows to manufacture the structural element in industrially prefabricated form with great dimensions and thereafter to cut or severe the same in the desired dimensions in dependence upon the heat requirements or ambient conditions. Practically universal adaptability of the structural heat-exchange element to the respective rough-in spaces is attained. The ceramic foam material of the body portion and of the outer wall portions is completely heat-resistant and corrosion-resistant. It is free from hydraulic binding materials and organic substances, whereby it is not susceptible to corrosion or the action of ions. The ceramic foam material of the body portion is noise-absorbing and prevents generation of stream noise and crack noise in case of the utilization of the structural element as a heating body or a cooling body. The inventive structural heat-exchanges element can be utilized in conduit systems and particularly in heating systems, especially in open systems with oxygen supply elements and antifreezing elements without danger of being corroded.

A further substantial advantage of the structural heat-exchance element is that the ceramic foam material or ceramically bonded expanded clay has such a strength that the inventive structural element can be directly built in a structural body as a self-supporting structural part as a component of floors particularly as a direct floor component for floor heating or cooling, as a wall component in the entire space for heating and cooling purposes, as well as a ceiling component also for heating and cooling purposes.

Moreover, the formation of structural heat-exchange element from the body portion of ceramic foam material and the outer wall portions of ceramic material allows to advantageously utilize the inventive structural element for the rebuilding of buildings, and particularly for rebuilding all buildings, inasmuch as the inventive structural element provides for the additional heat insulation, on the one hand, and can be utilized as additional heating or cooling body, on the other hand. The structural heat-exchange element in accordance with the present invention can form not only wall elements, but also structural blocks for manufacturing floors, flat ceilings and outer ceilings. It can also be utilized as the conventional heating body for heating other spaces for water reservoirs, particularly swimming pools, inasmuch as because of its ceramic outer wall portions, the outer faces of the structural element are corrosion-free and do not decompose, as well as are corrosion-resistant. The manufacture of the structural element in accordance with the present invention can be carried out in a simple way so that the body portion of the ceramic foam material and the outer wall portions are first manufactured, and then the desired conduits are drilled or milled in the desired direction, so that each of the passages for passing the heat-carrying medium has at least an outer wall formed by the outer wall portion having the higher thermal conductivity, thereby the required heat transfer to the outer face is guaranteed.

In accordance with a further feature which is advantageous particularly for the industrial manufacture of the structural heat-exchange element in high lot sizes and for performing the intended functions, the body portion and the outer wall portions are of one piece with each other and constituted of the ceramic foam material, the passages are formed in the ceramic foam material, and the outer wall portions of the structural heat-exchange element are formed by compression of the material so as to impart the same higher density and thereby higher thermal conductivity as compared with the body portion. Such structural heat-exchange element can be produced as an article to be stored with great length and dimensions, and thereafter it can be cut into desired dimensions in accordance with the requirements of the subsequent utilization. It forms a compact structural part which can be built in with favorable results, as supporting, at least self-supporting component of building parts.

In accordance with still another advantageous feature of the present invention, two opposite sides of structural heat-exchange element are provided with passages in the body portion and in the outer wall portions. Such a construction allows to utilize the structural heat-exchange element as double heating or double cooling body which acts, for example, as a wall component with heat insulating zone and can operate at both sides of the wall. Such a construction also allows to utilize one wall region for example for absorption of outer heat, and to utilize the other wall region, as a rule the inwardly located region, for emission of heat. Such a structural heat-exchange element is advantageously connected with a heating circuit which operates with a heat accumulator and heat pump.

The heat-exchange element with the outer wall portions of the compressed foam material can be produced by a manufacturing process including the formation of the outer wall portions in pyroplastic states, and thereby during the respective heating process of manufacturing the entire structural element of ceramic foam material. Thereby the respective passages can be formed with the respective configuration, particularly drilled or milled.

In accordance with yet another feature of the present invention at least part of the passages may be formed as open-end longitudinal recesses in the surface of the body portion, the recesses being closed by plate-shaped closure members forming the outer wall portions and consisting, for example, of ceramic material. The body portion can be formed with the respective open conduits in the desired dimensions by molding or working out. After this, the heat-exchange structural element is assembled with the aid of the closure members and the initially open conduits become closed.

In accordance with a further different feature of the present invention, it is also possible to form at least a part of the passages as open longitudinal recesses in the closure members corresponding to the outer wall portions, the recesses being closed by the abutting body portion. In this case, the body portion can be manufactured as a simple structural block and form the respective inner wall of the passages for the heat-carrying medium, whereas the plate-shaped closure members are provided with conduits and together with the body portion form the respective passages in the entire structural body.

When the structural heat-exchange element is first manufactured so as to have maximum dimensions and then to be cut into respective smaller dimensions, it will become necessary to provide connection of the individual passages with one another. In accordance with still a further feature of the present invention, the conduits for the heat-carrying medium include a plurality of passages which extend in the longitudinal direction of the structural element and are open at the end faces of the latter, and the recesses are provided for connecting the ends of at least two adjacent passages. These recesses may be formed in the end faces of the body portions and outwardly closed by closing plates which abut against the end faces of the body portion. On the other hand, the recesses may be formed in the closing plates which abut against the above-mentioned end faces of the body portion. A simple structural element which is provided only with the longitudinal passages can be first manufactured and then cut into pieces of desired length. Then, the connecting conduits may be provided at the end faces of the structural element. In this case it is advantageous when the closing plates of the end faces are provided with through-going openings which form extensions of the respective passage ends. In such a construction, a continuous passage for the heat-carrying medium in the closing plates to the further systems is guaranteed.

For improving the heat-exchange characteristics of the structural heat-exchange element, it is advantageous in accordance with yet a further feature of the present invention, to increase the outer surface of the outer wall portions forming the passages, by profiling the same. This profiling can be obtained in a simple manner during the formation of the compressed outer wall portions. On the other hand, the profiling can be provided on the closure members forming the outer wall portions, during the manufacture of these members.

In accordance with yet a further feature of the present invention, the walls of the passages formed of the material of the body portion are coated with a smooth coating layer consisting for example of a ceramic glaze. This layer can be produced also during the compression of the outer face of the ceramic foam material either during the manufacturing process of the body portion, or of the one piece structural element, or of the closing plates during the heating process, or by subsequent thermal treatment. Such a coating layer and particularly the layer of ceramic glaze has a very small micro-roughness and is antiadhesive and thereby practically maintenance-free. It is also possible to apply a small layer of synthetic plastic material onto the wall of the passages, for example of thermo-setting or thermo-plastic synthetic material.

The configuration of the passages of the body portions and of the outer wall portions can be selected in accordance with the application requirements and with regard to the manufacturing process. In the illustrated construction the conduit connections may be produced via the end faces of the structural element. It is especially possible to form in the structural heat-exchange element meander-shaped passages in order to make possible especially effective heat exchange. When the passages are provided at both sides, the configuration of the passages can adapt to the desired application purposes in optimum manner. Thus, when the structural heat-exchange element in accordance with the invention is utilized as a wall element, the passages are formed in accordance with this function. They have a different configuration when the structural heat-exchange element is utilized as a floor or ceiling element for floor or ceiling heating or cooling. When the structural heat-exchange is utilized for the above-mentioned rebuilding purposes, the wall thickness and the passage configuration are determined by the insulating functions and the heat-exchange functions, particularly by heating functions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2, 3, 4, 5, 6:
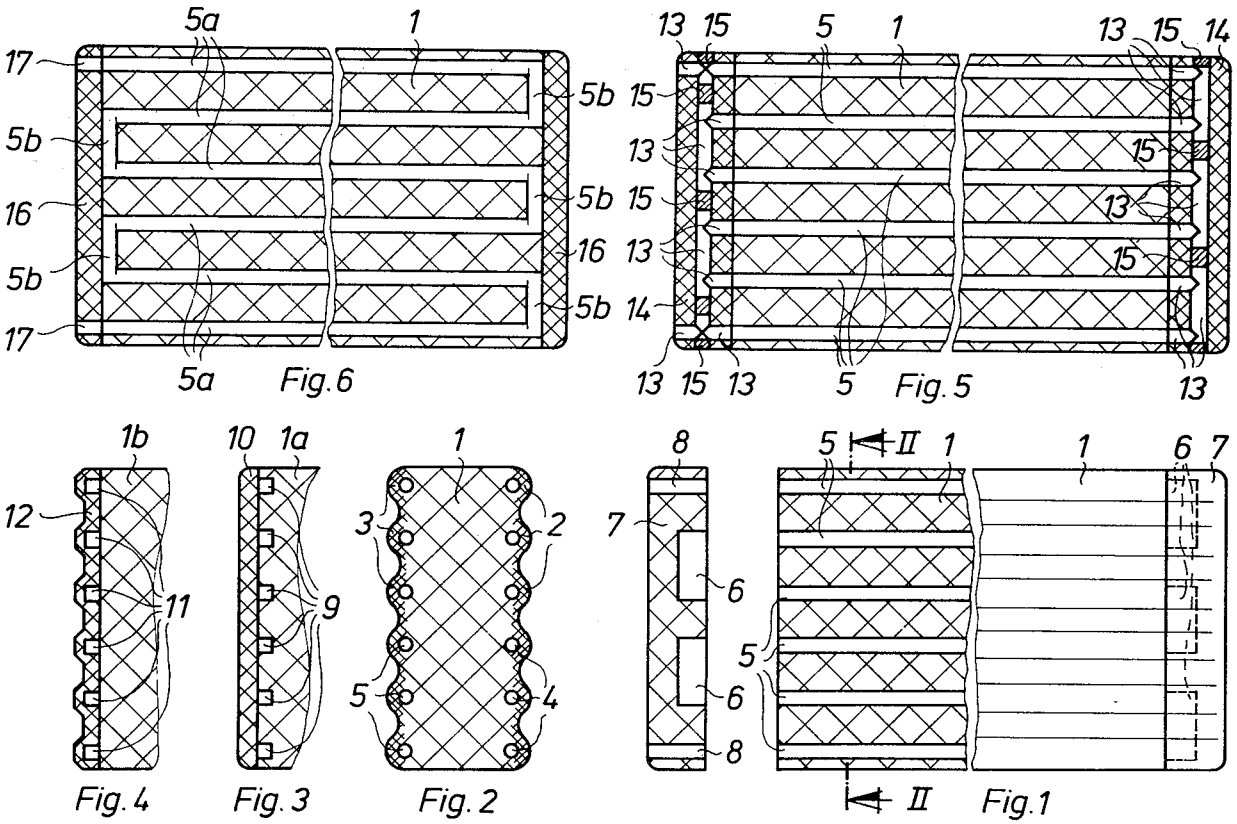
FIG. 1 is a partially sectioned side view of a structural heat-exchange element in accordance with the present invention, with a removed closing plate.
FIG. 2 is a view showing a section of the structural element of FIG. 1, taken along the line II—II.
FIGS. 3 and 4 are views substantially corresponding to the view of FIG. 2, but showing the structural element in accordance with further embodiments of the present invention.
FIGS. 5 and 6 are sectioned views substantially corresponding to the view of FIG. 1 but showing the structural element in accordance with two other embodiments of the invention.

A block-shaped or plate-shaped structural heatexchange element for installation purposes can be formed particularly as a heating or cooling body. The heat-exchange element is shown in FIGS. 1 and 2 in accordance with a first embodiment of the present invention and formed as a wall element with heat-exchange functions at its two sides.

The structural heat-exchange element has a body portion 1 of a ceramic foam material, particularly ceramically bonded expanded clay. The body portion of the ceramic foam material is designated in FIGS. 1 and 2 by wide hatching. As can be seen from FIG. 2, outer wall portions 2 and 3 of the same ceramic material bound the body portion 1 and are of one piece with the same. However, the material of the outer wall portions is compressed so as to have a higher density and thereby a higher thermal conductivity than the body portion 1. This is shown by the narrow hatching in FIG. 2.

Passages 4 and 5 for passing a heat-carrying medium are provided in the body portion 1 with its outer wall regions 2 and 3 at both sides of the structural element. The passages 4 and 5 may be, for example, drilled in the structural element. The passages 4 and 5 are so formed that at least the outwardly facing passage walls are formed from the material of the outer wall portions 2 or 3, as can be seen from FIG. 2.

The compression of the foam material in the outer wall regions 2 and 3 is advantageously performed in pyroplastic state of the foam material during the manufacturing process. As can further be seen from FIG. 2, the outer surfaces of the outer wall portions 2 and 3 are increased by profiling, for example in a wave-like form. The passages 4 and 5 are formed at both sides of the structural elements as longitudinal passages with the desired number.

The thus formed heat-exchange element can be utilized as double-sided heating or cooling body. The parallel longitudinal passages 4 and 5 are open at the side faces of the structural part, and the ends of the passages on the respective end faces are connected with one another by recesses 6 in closing plates 7. The closing plates 7 abut against the end faces of the structural part, or more particularly against the end faces of the body portion and the outer wall portions 2 and 3.

Connection of the closing plate 7 with the portions 1, 2 and 3 may be performed advantageously by gluing or by suitable connecting processes under the action of heat. The closing plate 7 which is shown at the left end in FIG. 1 is further provided with through-going openings 8 which form extensions of the open ends of the passages. These openings 8 serve for connecting the entire heating or cooling body to the outer conduit system. The closing plates 7 are advantageously constituted of the ceramic foam material either in the initial state or in the compressed state. The passages 5, the recesses 6 and the openings 8 shown in FIG. 1 may be provided at both sides of the structural element as illustrated in FIG. 2.

The structural heat-exchange element shown in FIG. 3 has a body portion 1*a* of ceramic foam material, in which passages 9 are formed as longitudinal recesses. The longitudinal recesses are formed in the surface of the body portion 1*a* and open at their one side. A plate-shaped closure member 10 of the ceramic material with increased thermal conductivity closes the open side of the recesses 9. The closure member 10 may also be constituted of compressed ceramic foam material so as to increase its thermal conductivity. It can be appreciated that the body portion 1*a* with its passages 2 at one or both sides can be easily manufactured, for example, by milling the passages 9. After this, the entire structural heat-exchange element can be produced by mounting the closure members 10 which close the passages 9 from outside.

In the embodiment shown in FIG. 4, structural heat-exchange element has a body portion 1*b* of ceramic foam material, without passages. Passages 11 are formed as longitudinal recesses provided in a plate-shaped closure member 12 with increased thermal conductivity and opened at their one side. The passages 11 are closed from inside by the surfaces of the body portion 1*b* abutting against the closure member 12. The plate-shaped closure member 12 may have the outer surface whose area is increased by profiling.

FIG. 5 shows still another embodiment of the present invention. The structural heat-exchange element has a plurality of the parallel passages 5 provided in the body portion 1. Here, the connection is performed on the end faces by separated passages 13 in closing plate 14 at both sides, and also by through-going openings in the left closing plate 14. The passages 13 can be first formed as through-going passages in the closing plates, and then separated from one another by a closing element 15. When the closing plate 14 shown at the left side is utilized at both sides, the through-going openings can be closed by closing blocks as illustrated for the longitudinal sides by the closing element 15. It is to be understood that in the construction shown in FIG. 5 the passages may be provided at both sides of the heat-exchange structural element, as illustrated in FIG. 2.

In the structural heat-exchange element shown in FIG. 6, passages 5*a* extend in meander-like manner in the body portion 1 of ceramic foam material. They are formed in such a manner that connecting portions 5*b* run on the end faces of the body portion 1 and are open at their one side. The connecting portions 5*b* of the passages 5*a* are closed at both sides by the closing plate 16 mounted on the end faces of the body portion. The left closing plate 16 are provided with through-going openings 17.

All closure members and closing plates are constituted of ceramic foam material, advantageously of the same ceramic material as the respective body portions 1, 1*a*, 1*b*. Advantageously, they are constituted of compressed ceramic foam material with increased thermal conductivity, as shown by the narrow hatching in the drawing. Advantageously, the inner walls of all passages, connecting passages, and throughgoing openings are provided with a smooth coating layer advantageously of ceramic clay. It is also understood from the shown examples and the preceding description that at least the body portion 1, 1*a*, 1*b* is prefabricated with desired maximum dimension and then are cut to pieces or severed in accordance with the desired final dimension.

It is also possible to subdivide the body portion 1 with the passages 4 and 5 of FIG. 2 in the central region into two plate-shaped structural heat-exchange elements provided with the passages at their one side. Such plate-shaped structural heat-exchange elements can be utilized as floor, ceiling or wall components with heat-exchange functions. FIGS. 1 and 2 also clearly show that the structural heatexchange element can also be utilized as a special heating and/or cooling body in buildings or swimming pools or the like, so as to perform the desired heat-exchange functions.

The structural heat-exchange elements in accordance with the invention may also be provided with vertical bores for receiving additional conduits or additional heating elements. Further, additional heat conductors or heat-conducting pipes may be inserted in the passages especially because of corrosion neutrality of the latter, so as to form emergency or additional heating means. This can be advantageous, for example, particularly for fast heating of temporarily utilized spaces and for frost-protection functions. The entire structural heat-exchange element in accordance with the invention is both inside and outside completely corrosion-proof and provides for inherently high noise absorption because of the ceramic foam material forming the same. Finally, the entire material of the structural heat exchange element in accordance with the present invention are fire-proof and unshrinkable which is especially important in view of the requirements made in the construction field. The specific feature of the invention is that the passages are bounded at at least their outer walls by the material of the outer wall portions with higher thermal conductivity, whereas the inner body portion of ceramic foam material is provided for both the mechanical strength and the heat and noise insulation. As mentioned above, such a structural heat-exchange element can be utilized for heat absorption via the outer wall portion with higher thermal conductivity and for conveyance of the absorbed heat through the passages. Gaseous media or vaporous media as well as liquid media particularly water, can be utilized as the heat-carrying medium in the inventive structural heat-exchange element.

The above-described closure parts 10 and 12 and the closing plate 7, 14 and 16 for the end faces can be constituted of ceramic or metallic material. In the latter case, the walls of the passages are advantageously coated and particularly enameled. The outer walls of the closure members 10 and 12, particularly those consisting of metallic material, can be provided with an outer coating for absorbing solar energy, so that the entire structural heat-exchange element can be formed as a solar collector. It is also possible to manufacture the closure members and/or the closing plates of ceramic material and combine the same inwardly or outwardly with metallic material.

The coating layers for the walls of the passages can further be constituted of fiber-reinforced synthetic plastic material, particularly of heat-conducting fiberreinforced synthetic plastic material, for improvement of the heat exchange properties.

It will be understood that each of the elements described above, or two or more together, may also find a useful application in other types of constructions differing from the types described above.

While the invention has been illustrated and described as embodied in a structural heat exchange element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A structural heat-exchanger element, comprising a structural part including a body portion of a ceramic foam material and outer wall portions spaced from one another in a first direction so as to laterally outwardly bound said body portion, at least one of said outer wall portions being constituted of a material having a higher thermal conductivity than the material of said body portion; and conduit means for passing a heat-carrying medium through said structural part, said conduit means being formed by a plurality of passages extending in said structural part in a second direction transverse to said first direction, each of said passages having at least an outer wall which is formed by said one outer wall portion constituted of the material having the higher thermal conductivity, said one outer wall portion being constituted of the same cermaric foam material of which said body portion is constituted but with the higher thermal conductivity, and being of one piece with said body portion.

2. A structural heat-exchange element as defined in claim 1, wherein said one outer wall portion has a higher density of the ceramic foam material than said body portion so as to impart the higher thermal conductivity to said one outer wall portion.

3. A structural heat-exchange element as defined in claim 2, wherein said one outer wall portion are compression-produced portion so as to impact the higher density to the same.

4. A structural heat-exchange element as defined in claim 1, wherein each of said passages is a circumferentially closed passage.

5. A structural heat-exchange element as defined in claim 1, wherein said body portion is elongated in said second direction and has an outer surface, at least some of said passages being formed by recesses which extend in said outer surface of said body portion in the direction of elongation of the latter and have an open side, said one outer wall portion being formed by a plate-shaped closure member arranged to close said recesses at said open sides of the latter.

6. A structural heat-exchange element as defined in claim 1, wherein said one outer wall portion is formed by a plate-shaped closure member which is elongated in said second direction, at least some of said passages being formed by recesses which extend in said closure member in the direction of elongation of the latter and have an open side, said body portion being arranged to abut against said closure member and to close said recesses at said open sides of the latter.

7. A structural heat-exchange element as defined in claim 1, wherein said structural part has two end surfaces spaced from one another in said second direction and is elongated in said second direction, said passages extending substantially parallel to each other and being open at said end surfaces of said structural part; and further comprising two closing plates each arranged at a respective one of said end surfaces of said structural part, and means for communicating at least two adjacent passages of said plurality with one another in the region of said end surfaces.

8. A structural heat-exchange element as defined in claim 7, wherein each of said passages has two end sections formed in said end surfaces, said communicating means including a plurality of communicating recesses formed in said end surfaces of said structural part, said closing plates being arranged to close said communicating recesses from outside.

9. A structural heat-exchange element as defined in claim 7, wherein said communicating means includes a plurality of recesses formed in said closing plates and each communicating the respective end sections of at least two adjacent passages, said body portion being arranged to close said communicating recesses from inside.

10. A structural heat-exchange element as defined in claim 7, wherein at least one of said closing plates has through-going openings each forming an extension of one of said passages.

11. A structural heat-exchange element as defined in claim 1, wherein said structural part has two sides spaced from one another in said first direction, said plurality of passages being formed in said body portion and in said one outer wall portion at one of said sides of said structural part, the other of said outer wall portions being also constituted of the same ceramic foam material but having the higher thermal conductivity than the material of said body portion and being of one piece with said body portion, and said conduit means including a further plurality of such passages formed in said body portion and in said other outer wall portion at the other of said sides of said structural part.

12. A structural heat-exchange element as defined in claim 11, wherein each of said outer wall portions is formed by a plate-shaped closure member laterally abutting against said body portion at a respective one of said sides of said structural part, at least one of said closure members being provided with an outer coating arranged to receive solar energy.

13. A structural heat-exchange element as defined in claim 1, wherein said one outer wall portion forming said outer wall of said passages has an outer surface which is profiled so as to increase the area thereof.

14. A structural heat-exchange element as defined in claim 1, wherein each of said passages has an inner wall which is formed by said body portion and together with said outer wall forms a common wall bounding the respective passage, at least said inner walls of said passages being provided with a smooth coating layer.

15. A structural heat-exchange element as defined in claim 14, wherein said coating layer is constituted of a ceramic glaze.

16. A structural heat-exchange element as defined in claim 14, wherein said coating layer is constituted of a fiber-reinforced synthetic plastic material.

17. A structural heat-exchange element as defined in claim 14, wherein said coating layer is constituted of a heat-conducting fiber-reinforced synthetic plastic material.

18. A structural heat-exchange element as defined in claim 1, wherein said structural part has two end surfaces spaced from one another in said second direction whereas said body portion has two lateral surfaces spaced from one another in said first direction, said outer wall portions being formed by two plate-shaped closure members each abutting against a respective one of said lateral surfaces of said body portion; and further comprising two closing plates each abutting against a respective one of said end surfaces of said structural part so as together with the latter communicate at least two adjacent passages of said plurality, said closure members forming a first group of closing elements whereas said closing plates form a second group of closing elements.

19. A structural heat-exchange element as defined in claim 18, wherein the closing elements of at least one of said groups are constituted of a ceramic material.

20. A structural heat-exchange element as defined in claim 18, wherein the closing elements of at least one of said groups are constituted of a metallic material.

21. A structural heat-exchange element as defined in claim 20, wherein each of said passages extend in the closing elements of at least one of said groups and is bounded by a circumferential wall which is enamelled.

* * * * *